US007594589B2

(12) United States Patent
Potts et al.

(10) Patent No.: US 7,594,589 B2
(45) Date of Patent: Sep. 29, 2009

(54) DUAL-CONTAINER PACKAGE AND A DISPENSING CLOSURE FOR SUCH PACKAGE

(75) Inventors: Craig L. Potts, Monclova, OH (US); Edward A. Grant, Northwood, OH (US); Leonora M. Brozell, Maumee, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 314 days.

(21) Appl. No.: 11/818,362

(22) Filed: Jun. 14, 2007

(65) Prior Publication Data

US 2008/0308558 A1 Dec. 18, 2008

(51) Int. Cl.
*B65D 1/24* (2006.01)
*B65D 1/36* (2006.01)
*B65D 25/04* (2006.01)

(52) U.S. Cl. ..... 220/500; 215/6; 222/129

(58) Field of Classification Search ..... 220/23.87, 220/23.89, 254.7, 255, 256.1, 367.1, 780, 220/500, 506, 526, 528; 215/6, 10, 273, 215/274; 222/129

See application file for complete search history.

(56) References Cited

U.S. PATENT DOCUMENTS

| | | | | |
|---|---|---|---|---|
| 856,064 | A | | 6/1907 | Jackson |
| 1,418,814 | A | * | 6/1922 | Lutz et al. ..... 215/6 |
| 2,340,841 | A | | 2/1944 | Black |
| 2,438,906 | A | * | 4/1948 | Elsas et al. ..... 222/108 |
| 2,578,538 | A | | 12/1951 | Gray |
| 2,661,870 | A | | 12/1953 | Huenergardt |
| 2,784,875 | A | | 3/1957 | Brink |
| 3,157,315 | A | | 11/1964 | Blanco |
| 3,289,887 | A | | 12/1966 | Farrar et al. |
| 3,439,841 | A | | 4/1969 | Rhodes |
| 3,851,800 | A | | 12/1974 | Swain |
| 4,585,150 | A | | 4/1986 | Beacham et al. |
| 4,678,103 | A | | 7/1987 | Dirksing |
| 4,730,381 | A | | 3/1988 | Dirksing |
| 4,993,595 | A | | 2/1991 | Bertram et al. |

FOREIGN PATENT DOCUMENTS

| | | |
|---|---|---|
| GB | 965508 | 7/1964 |
| JP | 2003118752 | 4/2003 |
| WO | WO 97/18138 | 5/1997 |
| WO | WO 2006/102472 | 9/2006 |

* cited by examiner

*Primary Examiner*—Harry A Grosso

(57) ABSTRACT

A dual-container package includes a closure having a body with a first annular wall extending from the body, a second annular wall extending from the body within the first annular wall, a first dispensing opening extending through the body from between the first and second annular walls, and a second dispensing opening extending through the body from within the second annular wall. A first container is mounted to the closure by the first annular wall, and a second container is disposed within the first container and mounted to the closure by the second annular wall. The containers and the annular walls have structure for holding the containers in a predetermined angular orientation with respect to each other. In the exemplary embodiments of the disclosure, this structure includes internal beads on the annular walls received by snap fit within external channels on the neck finishes of the containers. Slots on the internal beads of the closure are received by snap fit over lugs in the container neck finish channels to prevent rotation of the containers with respect to the closure. The containers have sidewalls that can include indicia that are held in radial alignment by the closure.

8 Claims, 4 Drawing Sheets

DUAL-CONTAINER PACKAGE AND A DISPENSING CLOSURE FOR SUCH PACKAGE

The present disclosure relates to a dispensing closure for a dual-container package with facility for holding the containers in a predetermined angular orientation with respect to each other, and to a dual-container package that includes such a closure.

BACKGROUND AND SUMMARY OF THE DISCLOSURE

A general object of the present disclosure is to provide a dual-container package in which the containers are held in a predetermined angular orientation with respect to each other, and to provide a closure for such a package.

The present disclosure embodies a number of aspects that can be implemented separately from or in combination with each other.

A dual-container package in accordance with one aspect of the present disclosure includes a closure having a body with a first annular wall extending from the body, a second annular wall extending from the body within the first annular wall, a first dispensing opening extending through the body from between the first and second annular walls, and a second dispensing opening extending through the body from within the second annular wall. A first container is mounted to the closure by the first annular wall, and a second container is disposed within the first container and mounted to the closure by the second annular wall. The containers and the annular walls have structure for holding the containers in a predetermined angular orientation with respect to each other. In the exemplary embodiments of the disclosure, this structure includes internal beads on the annular walls received by snap fit within external channels on the neck finishes of the containers. Slots on the internal beads of the closure are received by snap fit over lugs in the container neck finish channels to prevent rotation of the containers with respect to the closure. The containers have sidewalls that can include indicia that are held in radial alignment by the closure.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
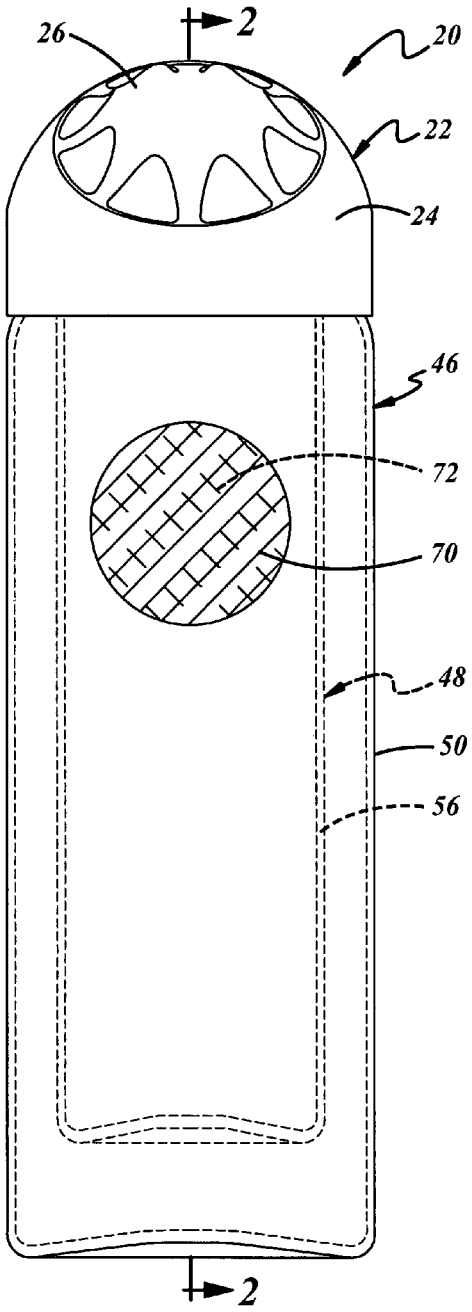
FIG. 1 is an elevational view of a dual-container package in accordance with one exemplary embodiment of the present disclosure.

FIGS. 1-4 illustrate a dual-container package 20 in accordance with a first exemplary embodiment of the present disclosure. Package 20 includes a plastic closure 22 having a body 24 and a cap 26 removably secured to body 24. A first annular wall 28 extends from body 24 and a second annular wall 30 extends from body 24 within wall 28. Annular walls 28, 30 preferably are circular and concentric. First annular wall 28 has an internal bead 32 and second annular wall 30 has an internal bead 34. A first dispensing opening 36 extends through body 24 from between first and second annular walls 32,34, and a second dispensing opening 38 extends through body 24 from within annular wall 34. In the exemplary embodiment of FIGS. 1-2B, dispensing openings 36, 38 are radially aligned. A first vent passage 40 preferably extends through closure body 24 from between annular walls 28,30, and a second vent passage 42 preferably extends through body 24 from within annular wall 30. In the exemplary embodiment of FIGS. 1-2B, vent passages 40, 42 are diametrically spaced from dispensing openings 36,38. Dispensing openings 36,38 and vent passages 40,42 preferably terminate at a flat outwardly facing surface 44 that is selectively covered by cap 26 to close the dispensing openings and vent passages.

Figure 2:
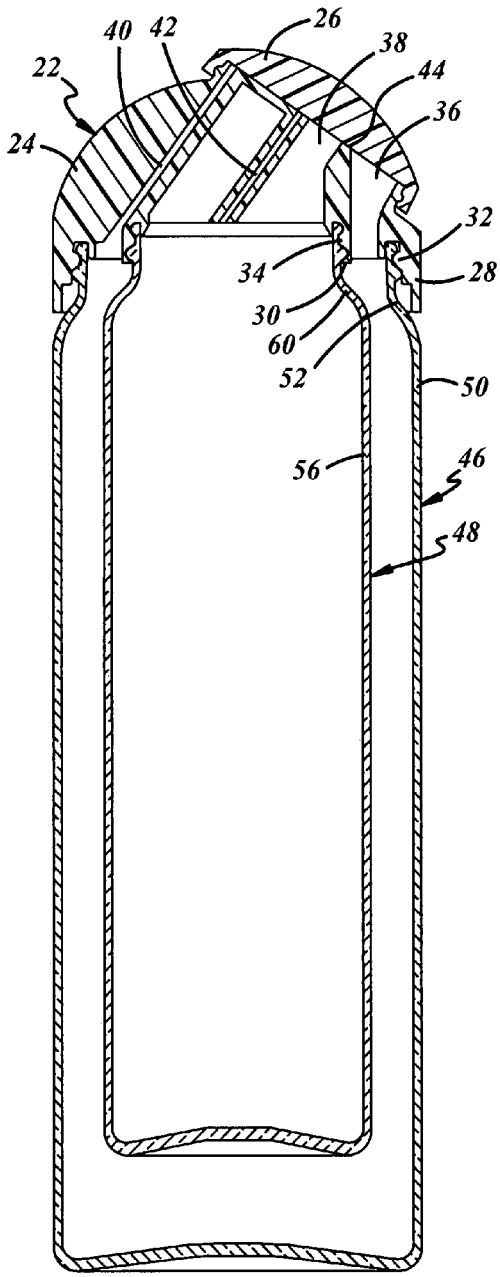
FIG. 2 is a sectional view taken substantially along the line 2-2 in FIG. 1.
Figure 2A:
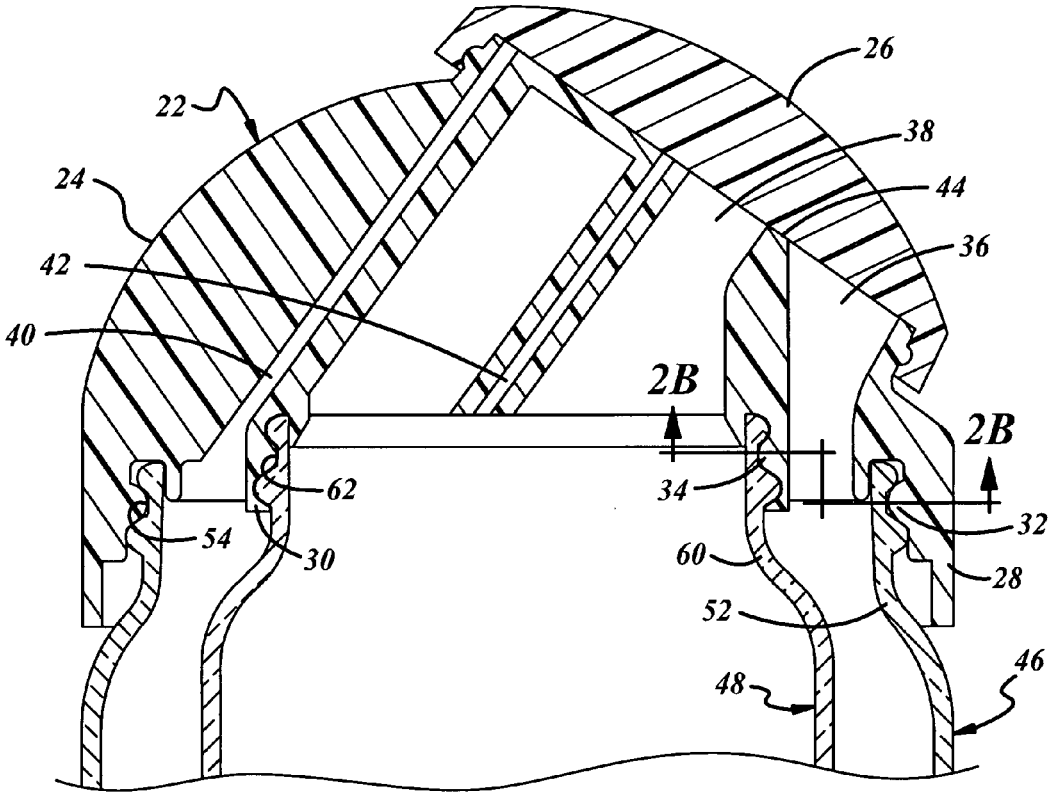
FIG. 2A is an enlargement of a portion of FIG. 2.
Figure 2B:
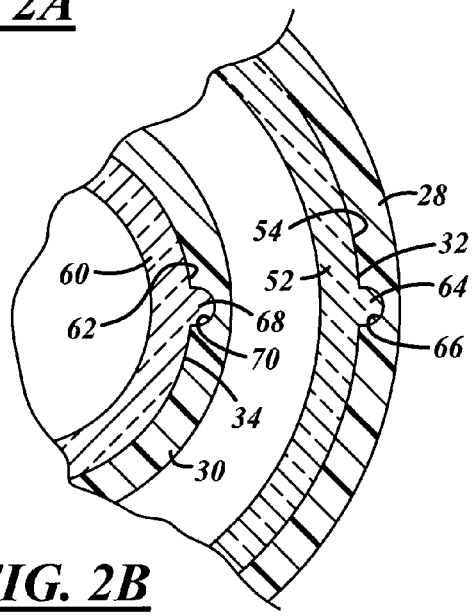
FIG. 2B is a fragmentary sectional view taken substantially along the line 2B-2B in FIG. 2A.
Figure 3:
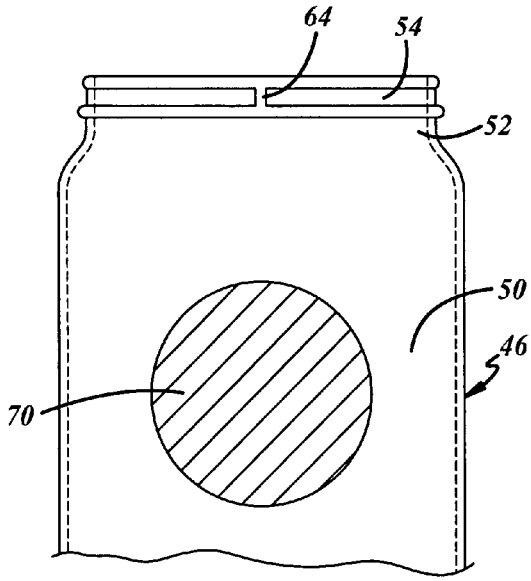
FIG. 3 is a fragmentary elevational view of the outer container in the package of FIGS. 1-2.
Figure 4:
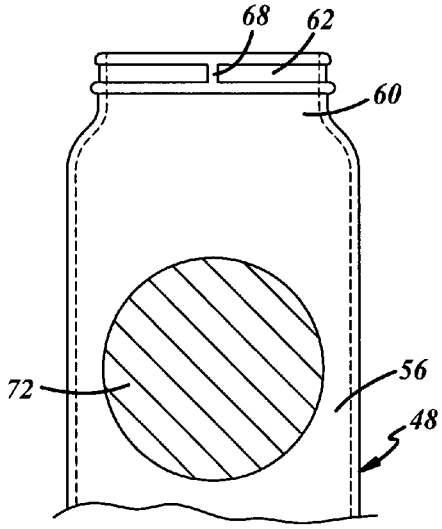
FIG. 4 is a fragmentary elevational view of the inner container in the package of FIGS. 1-2.

A first container 46 is mounted to first annular wall 28 of closure 22, and a second container 48 is mounted to second annular wall 30 of closure 22. Container 46 includes a sidewall 50 that terminates in a neck finish 52 with a radially outwardly extending channel 54 (FIGS. 2A-3) received by snap fit over internal bead 32 on closure first annular wall 28. Likewise, container 48 has a sidewall 56 that terminates in a neck finish 60 with a radially outwardly opening channel 62 (FIGS.2A-2B and 4) received by snap fit over internal bead 34 on closure annularwall 30. Channels 54, 62 preferably are defined by axially spaced external beads on neck finishes 52, 60, as best seen in FIGS. 2A and 3-4. Closure annular walls 28,30 thus mounts container 48 within container 46, preferably centrally and coaxially within container 46. Neck finish 52 of outer container 46 has an external lug 64 (FIG. 3) disposed in channel 54 that is received by snap fit in assembly (FIG. 2B) within a notch or recess 66 in internal bead 32 of closure wall 28. Likewise, neck finish 60 of container 48 has an external lug 68 (FIG. 4) within channel 62 that is received by snap fit in assembly within a recess or pocket 70 in internal bead 34 of closure annular wall 30 (FIG. 2A). Lugs 64, 68 preferably comprise ribs that extend axially between the external beads on the respective neck finish.

Thus, containers 46,48 are non-rotatable on closure 22 and are held at an angular orientation with respect to each other that is predetermined by the angular positions of notches 66, 70. These notches can be in radial alignment as shown in FIG. 2B. This non-rotatable container mounting arrangement can have several applications. For example, if containers 46,48 were non-circular such as oval, the non-rotatable mounting arrangement could hold the containers concentric with each other. With containers having cylindrical sidewall geometries as illustrated in FIGS. 1-4, the non-rotatable mounting arrangement can function to align indicia 70,72 on the respective container sidewalls. Such indicia 70,72 can comprise any suitable labeling. In the preferred implementation of the disclosure in which containers 46,48 are of glass construction, indicia 70,72 can comprise applied ceramic labeling. Such labeling can be decorative, or can comprise logos or information associated with the products within the containers. The indicia 72 on inner container 48 could be invisible until the product within the outer container falls beneath the level of the indicia on the inner container. In any event, the indicia 70,72 preferably are held in radial alignment as illustrated in FIG. 1. Containers 46, 48 alternatively can be of plastic construction.

Figure 5:
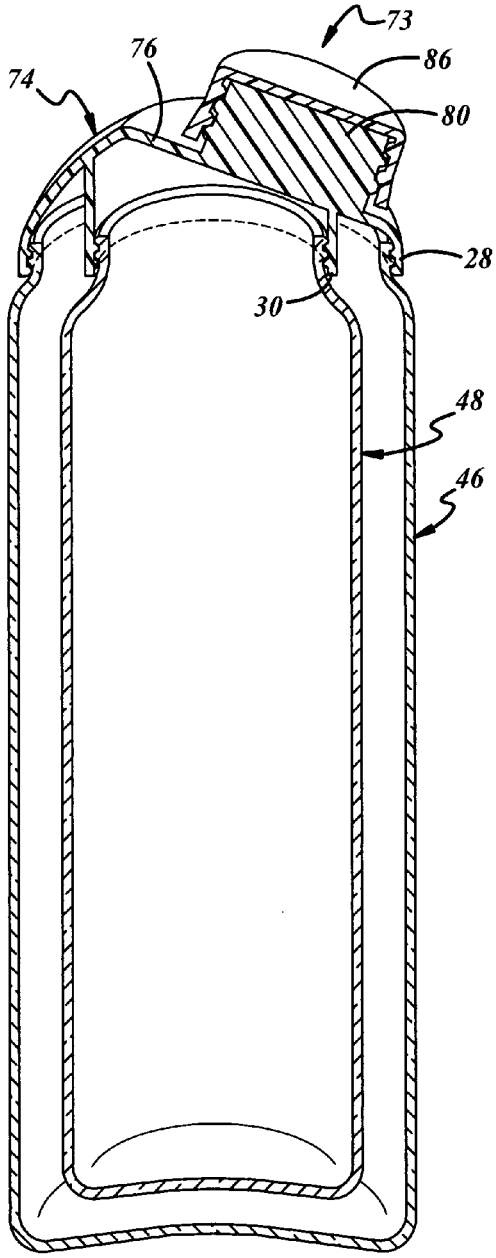
FIG. 5 is a sectional view of a dual-container package in accordance with a second exemplary embodiment of the present disclosure.
Figure 6:
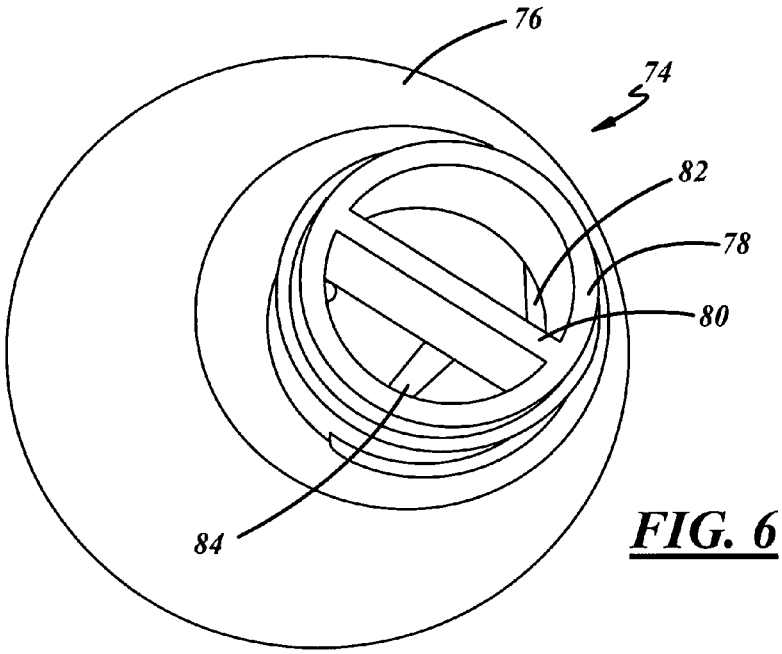
FIG. 6 is a top perspective view of the closure in the package of FIG. 5.
Figure 7:
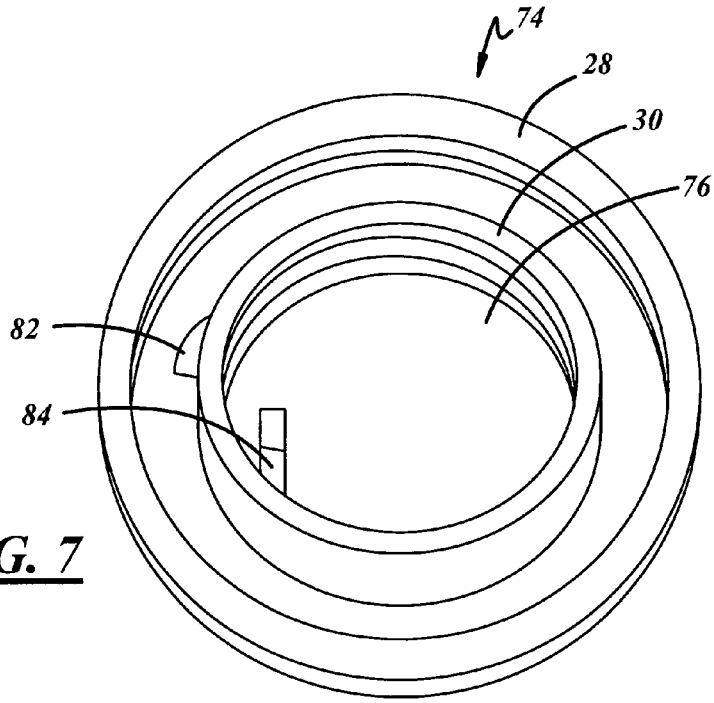
FIG. 7 is a bottom perspective view of the closure in FIG. 6.

FIGS. 5-7 illustrate a package 73 and a dispensing closure 74 in accordance with a second exemplary embodiment of the present disclosure. Reference numerals in FIGS. 5-7 that are identical to numerals in FIGS. 1-4 indicate identical or related components. Dispensing closure 74 includes a body 76 with first and second annular walls 28,30 as previously described. The outlet of closure 74 includes a third annular wall 78 and a septum 80 extending across the third annular wall, as shown in FIG. 6. A first outlet opening 82 extends through closure body 76 from between annular walls 28,30 to a D-shaped chamber formed on one side of septum 80. A second outlet opening 84 extends through closure body 76 from within annular wall 30 to a second D-shaped chamber formed on the opposing side of septum 80. A cap 86 is threaded or otherwise received over annular wall 78 normally to close the outlet chambers. In either exemplary embodiment of the disclosure, removal of the cap 26 or 86 permits simultaneous dispensing of product from within the respective containers. The ratio of such product dispensing is determined by the relative sizes of the dispensing openings 36,38 or 82,84. The closure construction preferably are such that the products do not mix until after dispensing. The volumes of the respective containers can be coordinated with the dispensing ratio so that the containers empty simultaneously.

There thus have been disclosed a dual-container package and a closure for such a package that fully satisfy all of the objects and aims previously set forth. The disclosure has been presented in conjunction with exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A dual-container package that includes:

a closure having a body, a first annular wall extending from said body, a second annular wall extending from said body within said first annular wall, a first dispensing opening extending through said body from between said first and second annular walls, and a second dispensing opening extending through said body from within said second annular wall, a first container mounted to said closure by said first annular wall, a second container disposed within said first container and mounted to said closure by said second annular wall, and means on said containers and said annular walls for holding said containers in a predetermined angular orientation with respect to each other, wherein said first and second annular walls on said closure body have internal beads, and said first and second containers have neck finishes with external channels received by snap fit over said internal beads to mount said containers to said annular walls, and wherein said means include a first lug disposed within said channel on said first container, a second lug disposed within said channel on said second container, a first slot on said internal bead on said first annular wall received by snap fit over said first lug, and a second slot in said internal bead on said second annular wall received by snap fit over said second lug.

2. The package set forth in claim 1 wherein said first and second containers have sidewalls and indicia on said sidewalls, and wherein said means function to hold said indicia in alignment in said package.

3. The package set forth in claim 1 wherein said closure includes an outlet composed of a third annular wall on said body, a septum extending across said third annular wall, said first and second outlet openings being disposed on opposite sides of said septum, and a cap removably received over said third annular wall.

4. The package set forth in claim 1 wherein said closure includes first and second vent passages in said body, said first vent passage opening between said first and second annular walls and said second vent passage opening within said second annular wall.

5. The package set forth in claim 1 wherein said first and second containers are of glass construction and said closure is of plastic construction.

6. A plastic closure that includes:

a body, a first annular wall extending from said body and including means for non-rotatably mounting a first container to said body, a second annular wall extending from said body within said first annular wall and including means for non-rotatably mounting a second container to said body within the first container, a first dispensing opening extending through said body from between said first and second annular walls, and a second dispensing opening extending through said body from within said second annular wall, wherein said first and second annular walls have respective internal beads with notches for snap receipt over lugs on the first and second containers so that the containers are non-rotatable with respect to said closure.

7. The closure set forth in claim 6 including an outlet composed of a third annular wall on said body, a septum extending across said third annular wall, said first and second outlet openings being disposed on opposite sides of said septum, and a cap removably received over said third annular wall.

8. The closure set forth in claim 6 including first and second vent passages in said body, said first vent passage opening between said first and second annular walls and said second vent passage opening within said second annular wall.

* * * * *